US005446981A

United States Patent [19]

Kamada et al.

[11] Patent Number: 5,446,981

[45] Date of Patent: Sep. 5, 1995

[54] METHOD OF SELECTING AUTOMATIC OPERATION MODE OF WORKING MACHINE

[75] Inventors: Seiji Kamada; Kazunori Kuromoto; Mamoru Tochizawa; Shuh Takeda, all of Hiratsuka, Japan

[73] Assignee: Kabushiki Kaisha Komatsu Seisakusho, Tokyo, Japan

[21] Appl. No.: 232,177

[22] PCT Filed: Oct. 29, 1992

[86] PCT No.: PCT/JP92/01400

§ 371 Date: Apr. 29, 1994

§ 102(e) Date: Apr. 29, 1994

[87] PCT Pub. No.: WO93/09300

PCT Pub. Date: May 13, 1993

[30] Foreign Application Priority Data

Oct. 29, 1991 [JP] Japan ..... 3-308281
Sep. 1, 1992 [JP] Japan ..... 4-255373

[51] Int. Cl.[6] ..... G05D 1/02

[52] U.S. Cl. ..... 37/348; 172/2; 364/424.07

[58] Field of Search ..... 37/348, 382, 414, 416; 414/699; 172/2, 4.5; 364/424.07

[56] References Cited

U.S. PATENT DOCUMENTS

| | | | |
|---|---|---|---|
| 4,829,418 | 5/1989 | Nielsen et al. | 172/4.5 X |
| 4,888,890 | 12/1989 | Studebaker et al. | 37/348 |
| 4,889,466 | 12/1989 | Jindai et al. | 172/4.5 X |
| 5,160,239 | 11/1992 | Allen et al. | 172/4.5 X |
| 5,178,510 | 1/1993 | Hanamoto et al. | 37/348 X |
| 5,257,177 | 10/1993 | Bach et al. | 414/699 X |
| 5,363,304 | 11/1994 | Awano et al. | 172/4.5 X |

FOREIGN PATENT DOCUMENTS

| | | | |
|---|---|---|---|
| 59-55924 | 3/1984 | Japan | 414/699 |
| 59-195937 | 11/1984 | Japan . | |
| 59-195939 | 11/1984 | Japan . | |
| 60-181429 | 9/1985 | Japan . | |
| 61-83727 | 4/1986 | Japan | 364/424.07 |
| 61-87033 | 5/1986 | Japan | 364/424.07 |
| 62-41826 | 2/1987 | Japan | 414/699 |
| 1-178620 | 7/1989 | Japan . | |
| 2-47432 | 2/1990 | Japan . | |
| 2-221527 | 9/1990 | Japan . | |
| 3-66838 | 3/1991 | Japan . | |
| 3-107026 | 5/1991 | Japan . | |
| 0681361 | 3/1994 | Japan | 37/416 |

*Primary Examiner*—Randolph A. Reese
*Assistant Examiner*—Victor Batson
*Attorney, Agent, or Firm*—Richards, Medlock & Andrews

[57] ABSTRACT

Even when a bucket is changed to an optional special bucket, path control as intended by an operator can be automatically performed without making a correction of the angle of the original bucket. For this purpose, in an operation mode determining section (9), there is calculated the possibility (U2) of an operation mode being a nose-fixed mode, depending on how much a bucket attitude angle ($\gamma$) deviates from a predetermined angle, and there is also calculated the possibility (U1) of the operation mode being the fixed-angle to the ground mode, depending on the magnitude of a computed value of the allowable angle held with respect to the ground, whereby the operation mode during the automatic path control can be automatically determined by comparing these possibilities (U1, U2).

20 Claims, 13 Drawing Sheets

METHOD OF SELECTING AUTOMATIC OPERATION MODE OF WORKING MACHINE

TECHNICAL FIELD

The present invention relates to construction equipment with a link-type working machine having a bucket or the like, such as a hydraulic power shovel, wherein path control of the tip of the working machine is carried out, and to a method of selecting an automatic operation mode for the working machine whereby a determination, of whether the control of an angle to the ground of the tip of the working machine should be carried out, is automatically made without requiring an input by an operator.

BACKGROUND ART

FIG. 1 shows a working machine of a hydraulic power shovel comprising a boom 1, an arm 2, a bucket 3, a boom cylinder 4, an arm cylinder 5, and a bucket cylinder 6. The boom 1, the arm 2, and the bucket 3 are moved by extending or contracting the cylinders 4, 5, or 6, respectively, causing a distal end of the bucket 3 to follow a predetermined path for excavation.

Conventionally, there are two modes of operation in automatic excavating path correction work by a hydraulic power shovel on a slope. In one mode (nose-fixed mode), as shown in FIG. 2A, the axes of the boom 1 and the arm 2 are activated in an interrelated manner to make the bucket nose excavate and finish a flat surface. In the other mode (fixed-angle to the ground mode), three axes, namely, the boom 1, the arm 2, and the bucket 3 are activated in an interrelated manner to perform excavation and surface finishing using a bottom surface of the bucket, as shown in FIG. 2B. Before beginning automatic operation, an operator must use a switch or the like to select between these two modes.

A prior art system for automatically selecting between the modes is disclosed in Japanese Patent Laid-Open No. 2-47432 publication, wherein a boom angle $\theta_1$, an arm angle $\theta_2$, a bucket angle $\theta_3$, a body inclination $\theta_0$, and a target excavating grade $\theta$, shown in FIG. 3 are inputted. An angle $\beta$ between the bottom surface of the bucket 3 and the flat surface, which is to be excavated, is determined at the beginning of the automatic operation from formula (1) below, and the computation result is compared with a predetermined value, thereby automatically determining the mode.

$$\text{ti } \beta = 3/2\pi - (\theta_0 + \theta_1 + \theta_2 + \theta_3 + \theta + \alpha) \quad (1)$$

(where e is the nose angle of the bucket).

Generally, in the case of the bucket used for the hydraulic power shovel, a standard tooth bucket shown in FIG. 4A needs to be replaced by various special buckets according to the particular work. On the other hand, however, a slope finishing bucket, shown in FIG. 4B, comes in an infinite number of shapes with more buckets being produced at general iron works, than genuine buckets produced by construction equipment manufacturers. Buckets produced by general iron works vary in dimensions from one bucket to another except for pin intervals of the buckets. In other words, the use of a method, wherein the mode is determined by determining the angle to the ground $\beta$ of the bucket bottom surface, poses a problem in that the nose angle $\alpha$ of the bucket must be corrected each time the bucket is changed except when a bucket having a predetermined shape is used.

Further, a problem arises when automatic operation is performed for purposes other than excavation. For example, if the position of a hook is linearly moved in suspension work, as shown in FIG. 5, the automatic determination by the described mode determination method erroneously selects the nose-fixed mode because of a significant difference between the target direction of movement and the orientation of the angle $\beta$ between the bottom surface of the bucket and the ground. This presents a problem in that the nose point moves as indicated by a solid line rather than moving along the path intended by the operator and indicated by a broken line.

Hence, in order to maintain the current angle to the ground $\beta$ when the direction of the movement of the working machine is given, the bucket 3 must be turned either to a dump truck side or an excavating side. For instance, as shown in FIG. 6A, if the angle of movement of the bucket 3 on the excavating side is small, then it soon becomes impossible to maintain the angle to the ground $\beta$ in the fixed-angle to the ground mode. Therefore, it is very likely that the operator's intention is the nose-fixed mode. On the other hand, if a bucket attitude angle $\gamma$, which is the attitude of the bucket 3 with respect to the arm 2, is large as shown in FIG. 6B, then the resulting path partially extends beyond (as shown by a hatched area) an arc drawn by the bucket nose point in the nose-fixed mode wherein the arm 2 is turned without moving the bucket 3 with respect to the arm 2. Therefore, a target excavating surface is ruined in the hatched area during automatic operation. Hence, it is very likely that the operator's intention in this case is the fixed-angle to the ground mode. Therefore, it is necessary to calculate these two possibilities and determine the automatic operation mode according to the magnitude of the calculated values.

Furthermore, an example of a prior art automatic operation in a power shovel is disclosed in Japanese Patent Laid-Open No. 2-221527 publication. It comprises an actuator controlling means, which controls actuators for an excavator; a working machine attitude detecting means, which detects the attitude angles of the boom, arm, and tip working machine of an excavating machine; a grade input means, which gives a target excavating grade for a surface to be excavated by the tip working machine; a distal end inclination input means, which gives a target inclination of the tip working machine with respect to a reference plane; and an actuator operating amount computing means, which computes an operating amount for moving the tip working machine at a determined specific speed with the given inclination and the given excavating grade in response to a detected value received from the working machine attitude detecting means and command values received from the grade input means and the tip inclination input means, and supplies the computed value to the actuator controlling means.

However, in such a control apparatus, it is necessary to specify input signals including a grade input, a control inclination input, and an excavating direction input for the excavating conditions of a slope surface at the time the automatic operation is begun. Furthermore, there is a problem in that the need for entering the input signals is easily forgotten, and all inputs must be checked for correctness each time before the automatic operation is started.

SUMMARY OF THE INVENTION

It is an object of the present invention to provide a method whereby the operation mode can be automatically determined without the need for determining the angle to the ground $\beta$ formed by the bottom surface of the bucket and a target grade, and without the need for correcting the specific nose angle $\alpha$ even when the bucket is replaced by any optional bucket having a special shape. The path control intended by an operator can be better performed automatically even when the suspension work is performed by a hook attached to the rear of the bucket. The arithmetic processing can be performed easily, and the automatic determination of the operation mode can be performed more easily since the operation mode is automatically determined by an allowable angle to the ground and the attitude of the nose.

It is another object of the present invention to provide a method whereby operator fatigue from operation is reduced to a minimum, and operation errors during excavating work are prevented by including the signals for the excavating direction among the signals entered during the excavating work.

According to the first aspect of the present invention, a construction equipment having a tip working machine, such as a bucket, wherein the distal end of the tip working machine is subjected to linear path control, is provided with: a tip working machine attitude detecting means which detects the bucket attitude angle $\gamma$, which is the relative attitude of the tip working machine with respect to the arm; an allowable angle computing section for calculating an angle $\delta$, which is an allowable angle held with respect to the ground and which indicates how long the tip working machine can hold the current angle to the ground in the turning direction d of the tip working machine, the angle $\delta$ being calculated from the bucket attitude angle $\gamma$ and the turning direction d of the tip working machine; and an operation mode determining section, which determines whether the operation mode is the nose-fixed mode, wherein the tip working machine holds the relative attitude with respect to the arm, or the fixed-angle to the ground mode, wherein the angle to the ground is held constant; the determination being made in accordance with the bucket attitude angle $\gamma$ and the allowable angle held with respect to the ground $\delta$ when the automatic path control is performed, the operation mode determining section calculating a possibility U2 of the operation mode being the nose-fixed mode, according to how far the bucket attitude angle $\gamma$ deviates from a predetermined angle and also calculating a possibility U1 of the operation mode being the fixed-angle to the ground mode, according to the magnitude of the calculated value of the allowable angle held with respect to the ground, and automatically determining the operation mode during the automatic path control by comparing the possibilities U1 and U2.

According to the second aspect of the present invention, a construction equipment having a tip working machine, such as a bucket, wherein the distal end of the tip working machine is subjected to linear path control, is provided with: a tip working machine attitude detecting means, which detects the bucket attitude angle $\gamma$ which is a relative attitude of the tip working machine with respect to the arm; an allowable angle computing section for calculating the allowable angle held with respect to the ground $\delta$, which indicates how long the tip working machine can hold the current angle to the ground in the turning direction d of the tip working machine, the angle $\delta$ being calculated from the bucket attitude angle $\gamma$ and the turning direction d of the tip working machine; and an operation mode determining section, which determines whether the operation mode is the nose-fixed mode, wherein the tip working machine holds the relative attitude with respect to the arm, or the fixed-angle to the ground mode, wherein the angle to the ground is held constant; the determination being made in accordance with the allowable angle held with respect to the ground $\delta$ when the automatic path control is performed, the operation mode determining section calculating the possibility U1 of the operation mode being the fixed-angle to the ground mode, according to the magnitude of the calculated value of the allowable angle held with respect to the ground, and automatically determining the operation mode during the automatic path control in accordance with the magnitude of the possibility U1.

According to the third aspect of the present invention, a construction equipment having a tip working machine, such as a bucket, wherein the distal end of the tip working machine is subjected to linear path control, is provided with: a tip working machine attitude detecting means, which detects the bucket attitude angle $\gamma$, which is a relative attitude of the tip working machine with respect to the arm; and an operation mode determining section, which determines whether the operation mode is the nose-fixed mode, wherein the tip working machine holds the relative attitude with respect to the arm, or the fixed-angle to the ground mode, wherein the angle to the ground is held constant; the determination being made in accordance with the bucket attitude angle $\gamma$ when the automatic path control is performed, the operation mode determining section calculating the possibility U2 of the operation mode being the nose-fixed mode, according to how far the bucket attitude angle $\gamma$ deviates from a predetermined angle, and automatically determining the operation mode during the automatic path control in accordance with the magnitude of the possibility U2.

In the individual aspects of the present invention described above, a mode determining switch can be used to select whether the operation mode is determined automatically or is forcibly set to the nose-fixed mode or to the fixed-angle to the ground mode. In addition, whether the current mode automatic determining value is for the nose-fixed mode or for the fixed-angle to the ground mode can be indicated by an indicator lamp according to an output from the operation mode control section. Furthermore, a knob switch can be provided on the operating lever of the working machine so that a determination value of the operation mode determining section is inverted and outputted when the knob switch is pressed.

According to the fourth aspect of the present invention, since it is generally true that the excavation is in the pulling direction when the distal end of the working machine is positioned at the back of a working area at the beginning of the excavation and is in the pushing direction when it is positioned at the front of the working area at the beginning of the excavation, the working area can be divided into two areas A and B by a boundary; a position detecting means provided on a working machine, which can be operated automatically, can determine to which of these two areas A and B a working condition, such as the angle and position of the working machine, belongs and thus determine whether the excavation is in the pushing direction or in the pulling direction in accordance with the area determination. For determining the direction of the excavation, priority can be given to a command received from an external input switch.

BEST MODE FOR CARRYING OUT THE INVENTION

Figure 1:
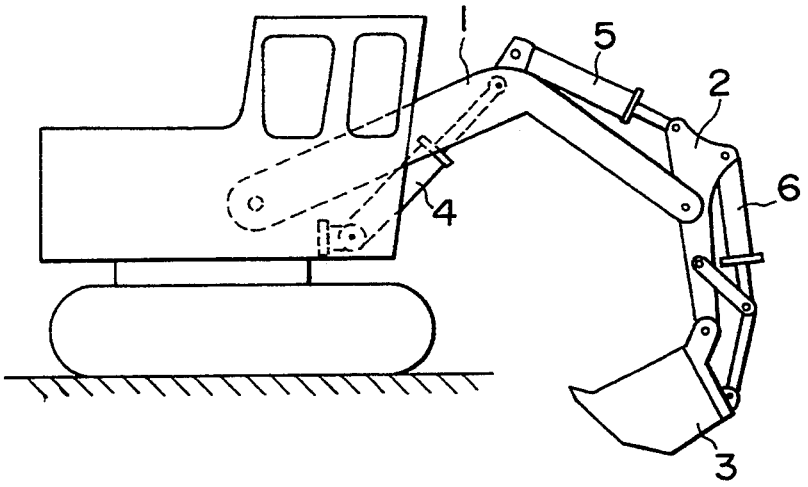
FIG. 1 (PRIOR ART)
FIG. 1 is a configuration explanatory view which shows the working machine of the hydraulic power shovel.
Figure 2A:
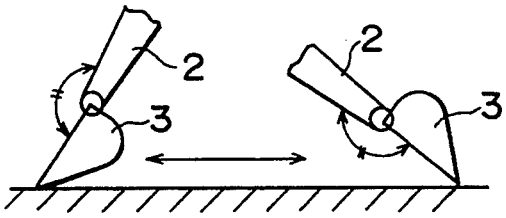
FIG. 2A (PRIOR ART)
FIG. 2A is a configuration explanatory view which shows the nose-fixed mode.
Figure 2B:
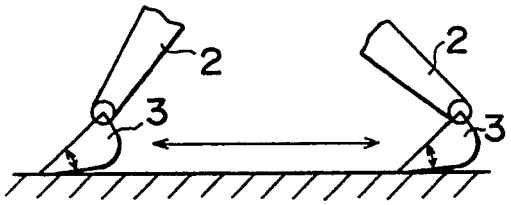
FIG. 2B (PRIOR ART)
FIG. 2B is a configuration explanatory view which shows the fixed-angle to the ground mode.
Figure 3:
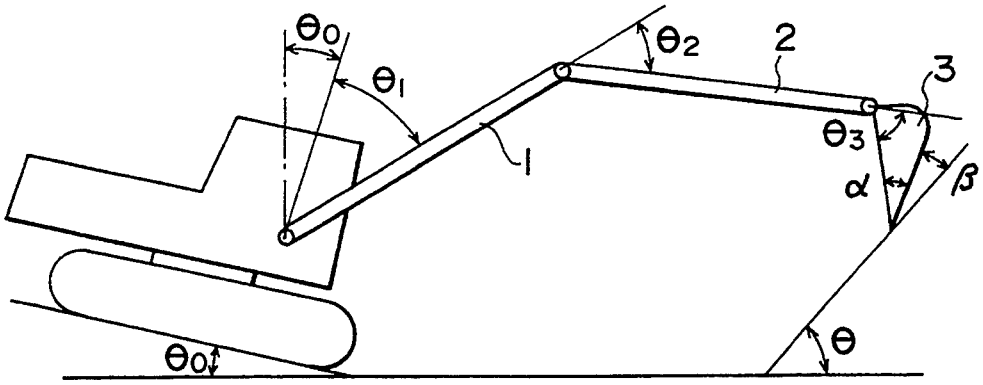
FIG. 3 (PRIOR ART)
FIG. 3 is an explanatory view of the prior art.
Figure 4A:
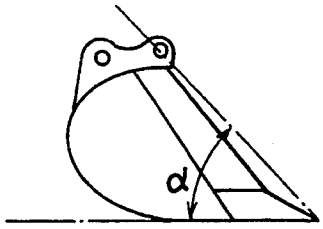
FIG. 4A (PRIOR ART)
FIG. 4A is a side view which shows the standard tooth bucket.
Figure 4B:
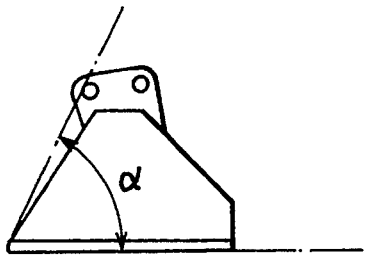
FIG. 4B (PRIOR ART)
FIG. 4B is a side view which shows the slope surface bucket.
Figure 5:
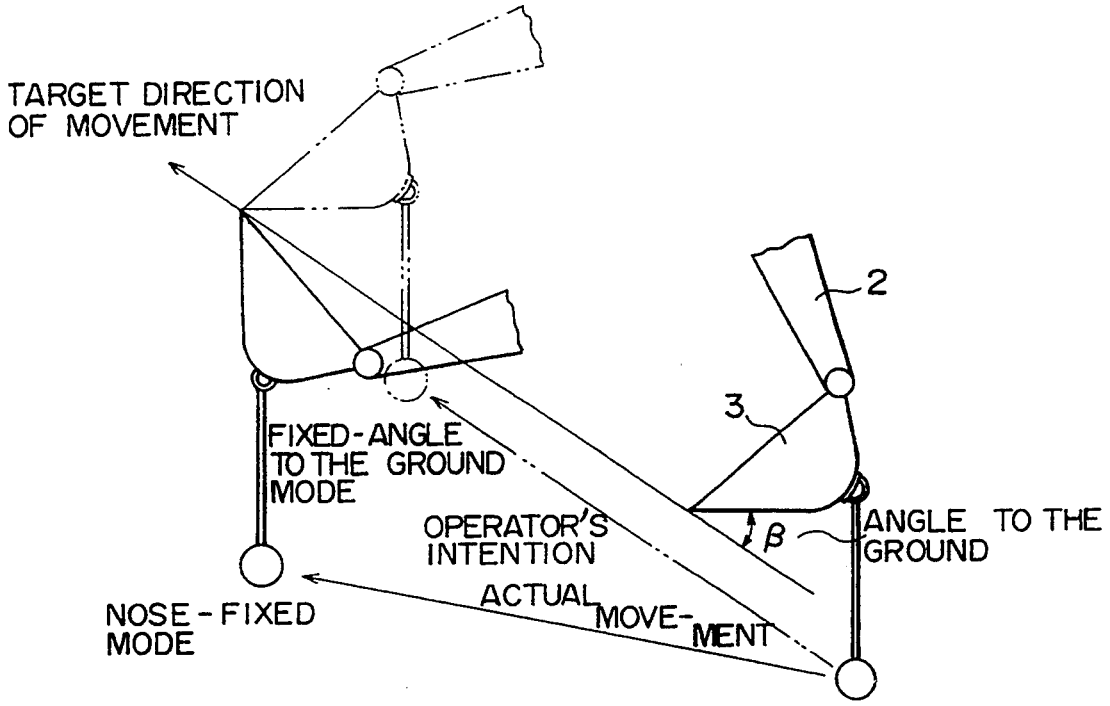
FIG. 5 (PRIOR ART)
FIG. 5 is a diagram which shows the suspension work by the bucket.
Figure 6A:
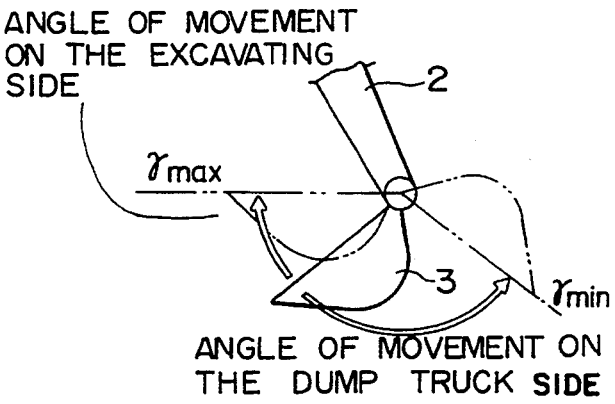
FIG. 6A (PRIOR ART)
FIG. 6A is a diagram which shows a state wherein the possibility of being the nose-fixed mode is high.
Figure 6B:
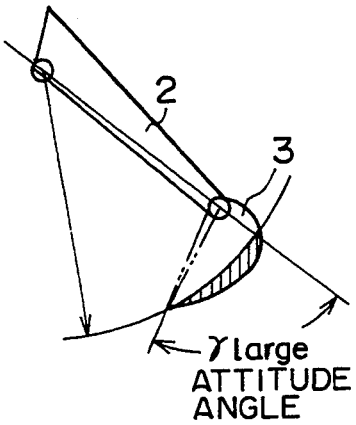
FIG. 6B (PRIOR ART)
FIG. 6B is a diagram which shows a state wherein the possibility of being the bucket fixed-angle to the ground mode is high.

The first embodiment of the present invention will be described with reference to FIG. 7A and other figures. The parts which are the same as those of the conventional example shown in FIG. 1 through FIG. 6B will be indicated by the same reference numerals and the explanation thereof will not be repeated.

Figure 7A:
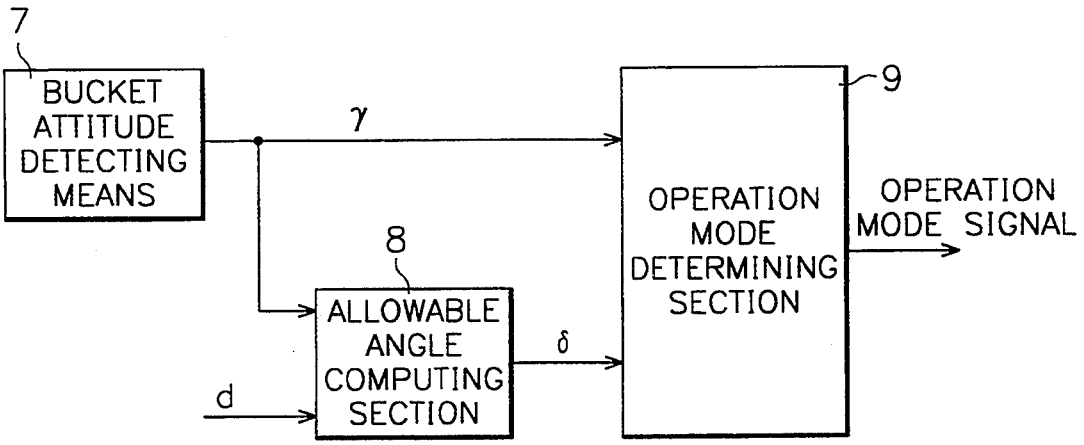
FIG. 7A is a block diagram which shows the first embodiment of the present invention.

In FIG. 7A, the bucket attitude detecting means 7 can determine the bucket attitude by various methods. In one method, the bucket attitude angle $\gamma$, which is the angle of the bucket 3 around the rotary shaft with respect to the arm 2, is detected by means of a potentiometer or a rotary sensor such as an encoder. In a second method, the attitude of a cylinder link section with respect to the arm 2 is detected by a rotary sensor, and a relative angle is determined from a geometric relationship of the link section rather than directly detecting the angle around the rotary shaft. In another method, the turning angle of the bucket 3 and the length of the cylinder stroke are detected by a direct-acting potentiometer or a linear encoder to determine the relative angle from the geometric relationship.

The computing section 8 determines the allowable angle held with respect to the ground by first determining the direction in which the bucket 3 has to turn to hold the angle to the ground in view of the turning direction d of the arm 2. For example, in general, the turning angle of the arm 2 is larger than that of the boom 1 during the nose path control; therefore, the bucket 3 turns in the opposite direction from the arm in order to maintain the angle to the ground constant.

The turning direction d of the arm 2 can be determined in accordance with the following methods:

(a) If the operator instructs the excavating direction through an instructing switch or the like, then whether a switch command signifies the arm excavating side ($d>0$) or the arm dump truck side ($d<0$) is determined from the state of the switch signal. This provides a unequivocal determination.

(b) In the case of an automatic operation based on the path control, wherein other shafts are automatically controlled in response to the leading operation of the arm shaft, and in the case of the master-slave type automatic operation, wherein the direction is instructed in terms of a vector input, the operation signal of the arm shaft can be determined as plus or minus with respect to the turning direction d.

(c) The turning direction d can be automatically determined by whether the attitude of the arm 2 at the beginning of the automatic operation is closer to the dump truck side or the excavating side. If the direction determining value is on the excavating side, then $d>0$; and if it is on the dump truck side, then $d<0$.

Figure 8A:
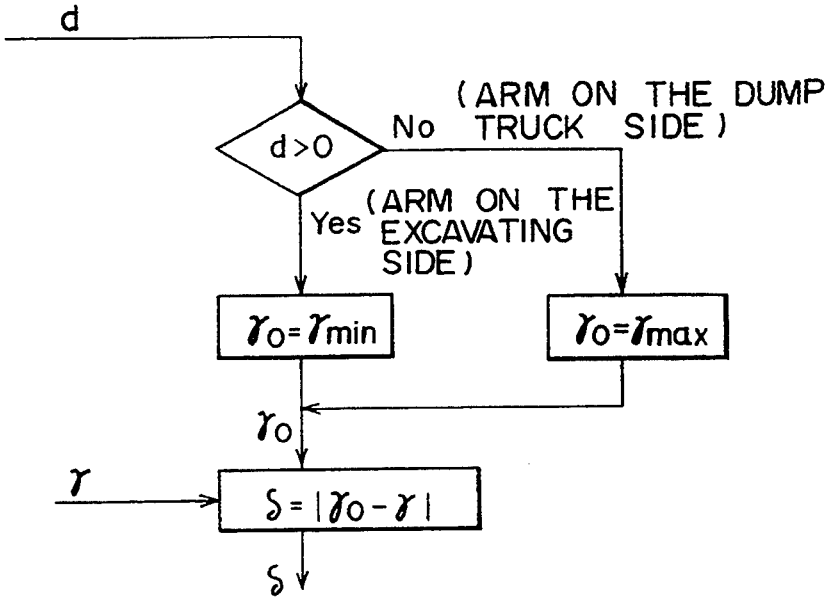
FIG. 8A is a block diagram which shows an algorithm for calculating the allowable angle held with respect to the ground.
Figure 8B:
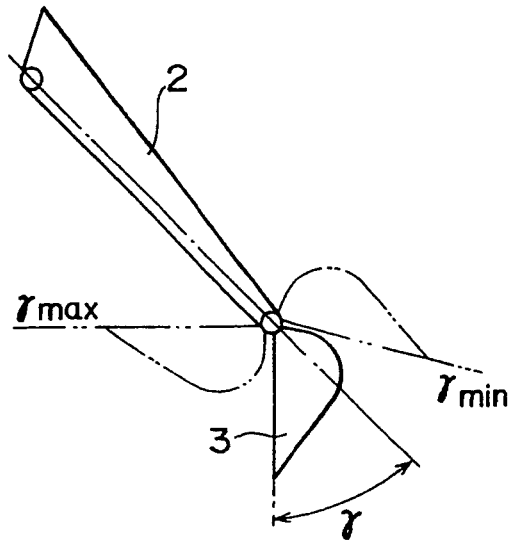
FIG. 8B is an explanatory view which shows the attitude of the bucket.

The turning direction d of the arm 2, which has been obtained in accordance with method (a), (b) or (c) described above, and the bucket attitude angle $\gamma$, which has been detected by the bucket attitude detecting means, are supplied to the allowable angle computing section 8 to determine the possible angle of rotation of the bucket 3 up to a stroke end angle $\gamma_0$ on the turning direction side according to the algorithm shown in FIG. 8A, and the determined value is taken as the allowable angle held with respect to the ground $\delta$. FIG. 8B is the explanatory view which shows the attitude $\gamma$ of the bucket 3 with respect to the arm 2.

Therefore;

$$\delta = |\gamma_0 - \gamma| \quad (2)$$

The bucket attitude angle $\gamma$ and the allowable angle held with respect to the ground $\delta$ thus obtained are supplied to the operation mode determining section 9 to provide a possibility signal as a function of the allowable angle held with respect to the ground $\delta$. For example, as shown in formula (3), the possibility signal U1 represents the possibility of the fixed-angle to the ground mode.

$$U1 = K_1 \cdot \delta \quad (3)$$

($K_1$ is an appropriate coefficient.)

As shown in formula (4), the possibility signal U1 can be established stepwise in accordance with the magnitude of the allowable angle held with respect to the ground $\delta$.

$$U1 = 0.1 \text{ (when } \delta \geqq C1) \quad (4)$$

$$U1 = 0.5 \text{ (when } C1 > \delta \geqq C2)$$

$$U1 = 0.0 \text{ (when } \delta < C2)$$

(C1 and C2 are predetermined threshold values of the allowable angle held with respect to the ground.)

On the other hand, the possibility signal U2, representing the possibility of the nose-fixed mode, the maximum attitude on the dump truck side ($\gamma = \gamma min$) is optimum because it is necessary to prevent the rear of the bucket 3 from contacting the excavated slope surface. Further, in general, the nose is positioned as an extension of the arm to secure a great length of excavation, thereby allowing a long reach ($\gamma = 0$); therefore, the possibility U2 can be given as a function of the bucket attitude angle $\gamma$ as shown in a formula (5):

$$U2 = K_2 \cdot (\gamma_S - \gamma)^2 \quad (5)$$

($K_2$ is an appropriate coefficient; $\gamma_S$ is a predetermined reference angle such as $\gamma_X = 0°$)

Or as with the aforesaid formula (4), the possibility U2 can be established stepwise in accordance with the magnitude of the bucket attitude angle $\gamma$.

Figure 9A:
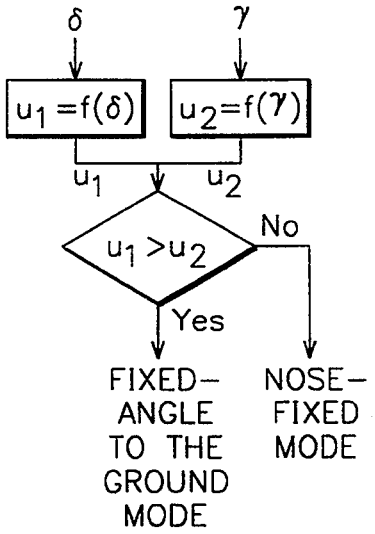
FIG. 9A is a block diagram which shows an algorithm of the first embodiment of the present invention.

The magnitudes of the possibility signals U1 and U2 thus obtained are compared in accordance with the algorithm shown in FIG. 9A: if U1>U2, then the fixed-angle to the ground mode is selected; and if U2>U1, then the nose-fixed mode is selected.

According to the first embodiment, a user does not have to correct the specific nose angle $\alpha$ even when the tip working machine, such as the bucket 3, is replaced by any optional special bucket; and the operation mode is automatically determined in accordance with the allowable angle with respect to the ground and the attitude of the nose even when suspension work is carried out by the hook attached to the rear of the tip working machine, enabling improved automatic path control as intended by the operator.

There is another method whereby the mode can be determined merely by the possibility U1 of the fixed-angle to the ground mode.

Figure 7B:
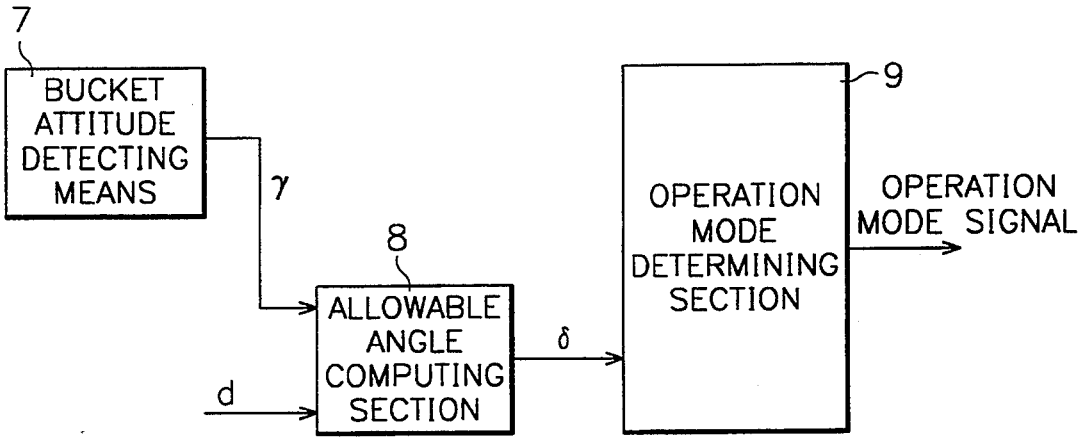
FIG. 7B is a block diagram which shows the second embodiment of the present invention.
Figure 9B:
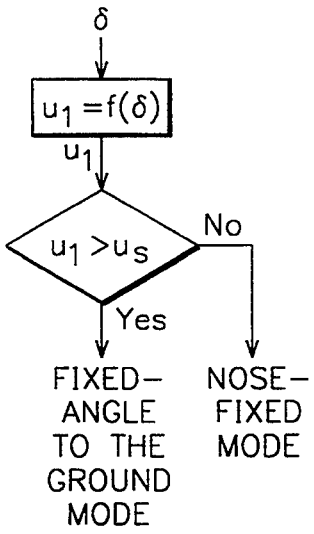
FIG. 9B is a block diagram which shows an algorithm of the second embodiment of the present invention.

FIG. 7B and FIG. 9B show the second embodiment. First, in FIG. 7B, only the allowable angle held with respect to the ground $\delta$, which has been calculated by the allowable angle computing section 8 from the bucket attitude angle $\gamma$ and the turning direction d of the bucket 3, is supplied to the operation mode determining section 9. In this case, the possibility of the operation mode being the fixed-angle to the ground mode is calculated in accordance with the magnitude of $\delta$, and the operation mode during the path control is automatically determined in accordance with the magnitude of this possibility. More specifically, as shown in FIG. 9B, the possibility U1 of the fixed-angle to the ground is determined from the allowable angle held with respect to the ground $\delta$, and the magnitude of the determination result is compared with that of a predetermined threshold value $U_S$. If $U1 > U_S$, then the fixed-angle to the ground mode is selected; while if $U1 < U_S$, then the nose-fixed mode is selected.

Alternatively, there is still another method whereby the mode is determined only from the possibility U2 of the nose-fixed mode.

Figure 7C:
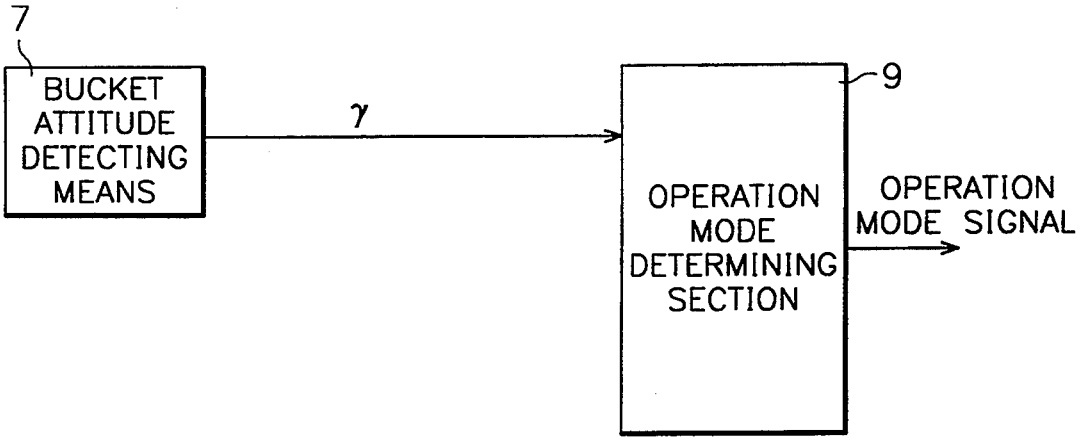
FIG. 7C is a block diagram which shows the third embodiment of the present invention.
Figure 9C:
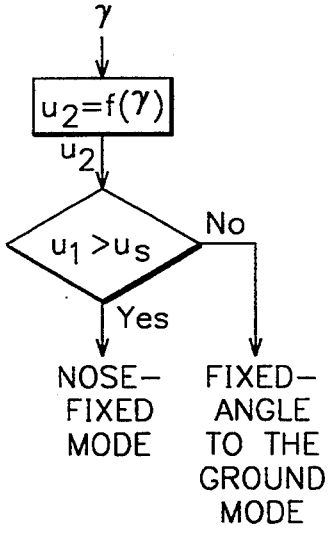
FIG. 9C is a block diagram which shows an algorithm of the third embodiment of the present invention.

FIG. 7C and FIG. 9C show the third embodiment. First, in FIG. 7C, the bucket attitude angle $\gamma$ is supplied to the operation mode determining section 9 which calculates the possibility of the operation mode being the nose-fixed mode according to how far the bucket attitude angle $\gamma$ deviates from the predetermined angle, and automatically determines the operation mode during the path control in accordance with the magnitude of the calculated possibility. More specifically, as shown in FIG. 9C, only the possibility U2 of the nose-fixed mode is compared with the predetermined threshold value $U_S$. If $U2 > U_S$, then the nose-fixed mode is selected; while if $U2 < U_S$, then the fixed-angle to the ground mode is selected.

In the second embodiment and the third embodiment, simplified automatic determination of the operation mode can be performed more easily by simplifying the arithmetic processing.

Figure 10A:
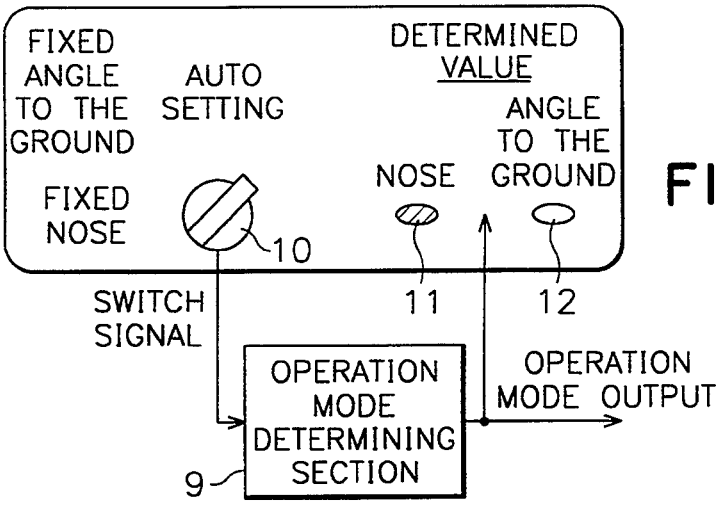
FIG. 10A is an explanatory view which shows an application example of the present invention.
Figure 10B:
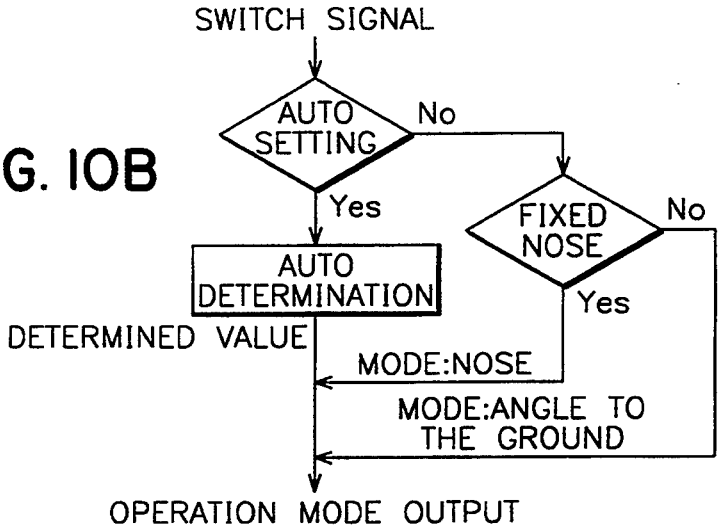
FIG. 10B is a block diagram which shows an algorithm of the application example.

FIG. 10A and FIG. 10B show an application example of the present invention. In FIG. 10A, a mode determining switch 10 allows the selection of one of the automatic setting mode, the fixed-angle to the ground mode, and the nose-fixed mode. The indicator lamps 11 and 12, such as LEDs, show the selection result. FIG. 10B shows the algorithm in this application example; the operation mode, which has been selected through the mode determining switch, is forcibly outputted. Then the mode can be checked by the lighting of the indicator lamps 11 and 12, thus making it possible to prevent the bucket 3 from taking a move which is not intended by the operator. This is effective when the operator wishes to operate only in one of the modes for safety. Furthermore, higher safety is secured since the operator can visually check the mode automatic determination value before starting the operation.

Figure 11A:
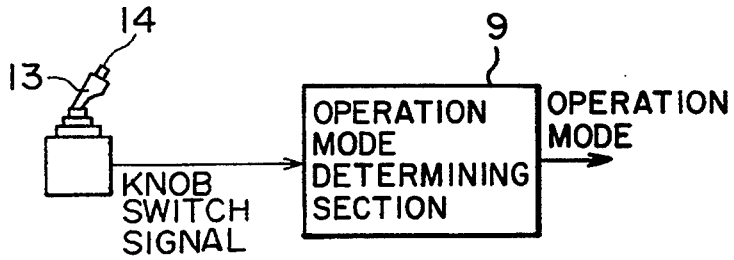
FIG. 11A is an explanatory view which shows a second application example of the present invention.
Figure 11B:
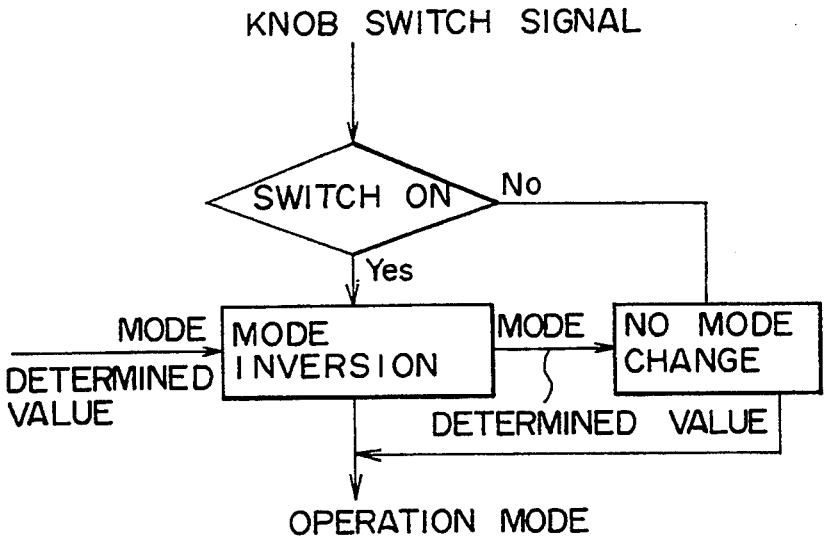
FIG. 11B is a block diagram which shows an algorithm of the second application example.

FIG. 11A and FIG. 11B show another application example. An operating lever 13 is provided with a knob switch 14 so that the mode determination value is inverted according to the algorithm shown in FIG. 11B if the knob switch 14 is pressed. If the mode is not what the operator intended, then the operator can invert the mode, enabling him to continue the automatic operation without releasing the operating lever.

The fourth embodiment of the present invention will now be described with reference to the drawings.

Figure 12:
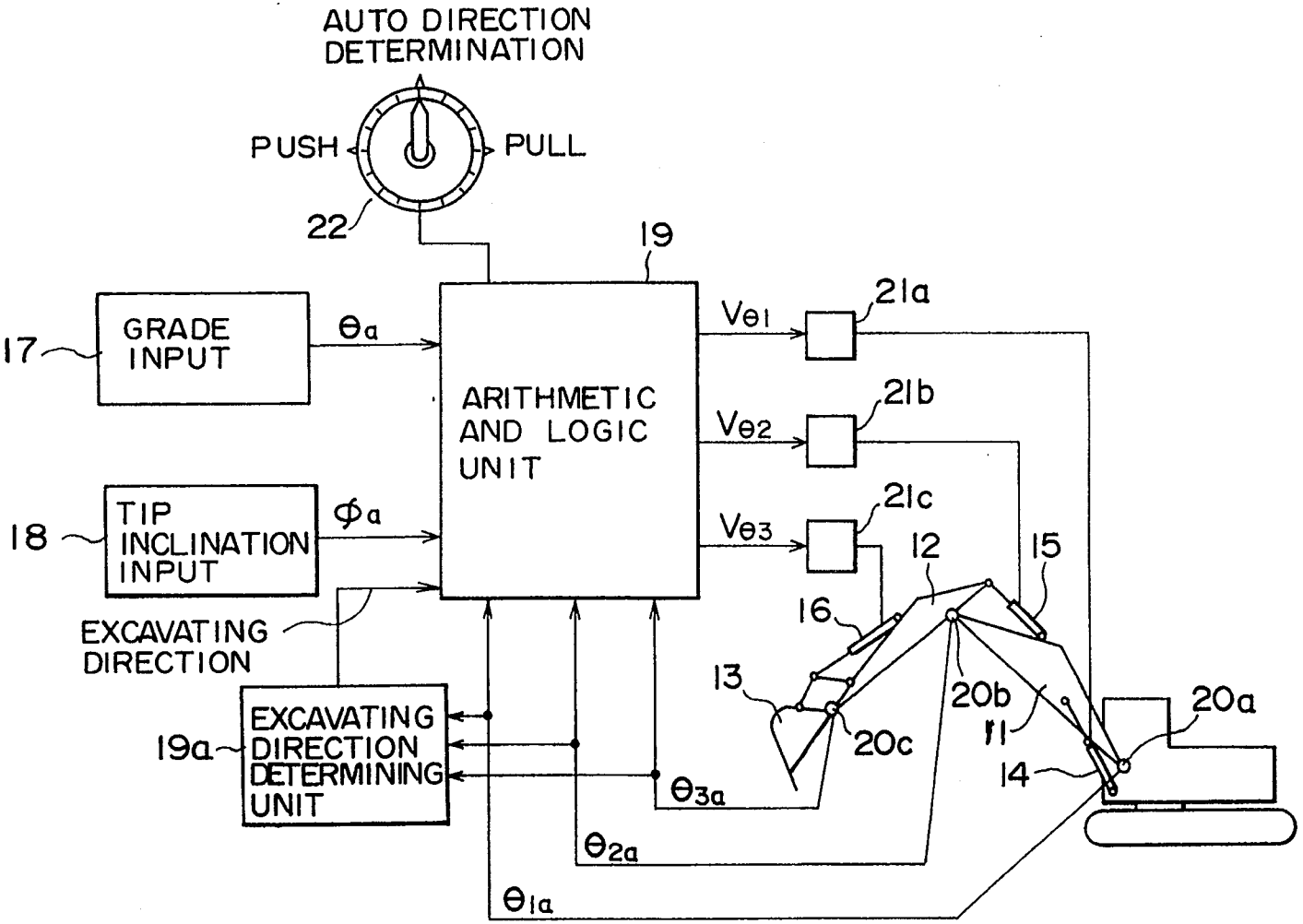
FIG. 12 is a block diagram which shows the fourth embodiment of the present invention.
Figure 13:
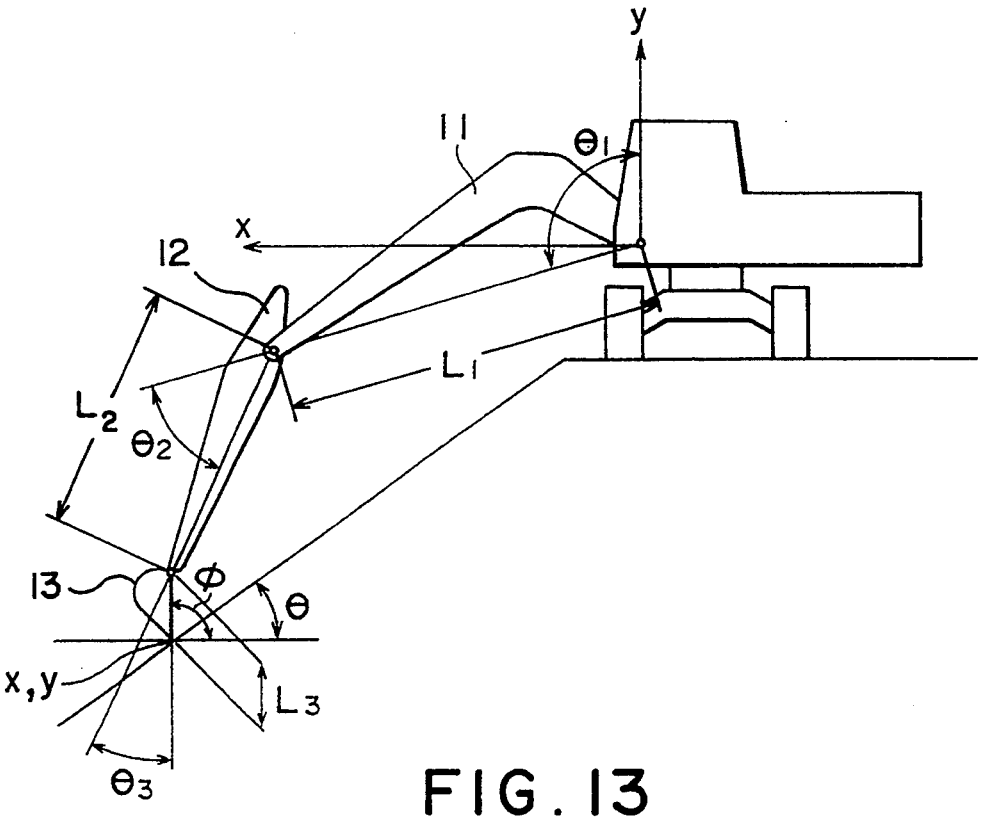
FIG. 13 is an explanatory view of the attitude of each component of the working machine.

FIG. 12 is the block diagram which shows the fourth embodiment. For the sake of the description given below, the angles and positions of the individual components of the power shovel are defined as shown in FIG. 13. Specifically, the turning angle of a boom 11 is defined as $\theta_1$, the turning angle of an arm 12 with respect to boom axis as $\theta_2$, the turning angle of a bucket 13 with respect to the arm axis as $\theta_3$, the inclination of the bucket 13 with respect to the horizontal surface (reference surface) as $\phi$, the length of the boom 11 as $L_1$, the length of the arm 12 as $L_2$, the length of the bucket 13 as $L_3$, the longitudinal position of the distal end of the bucket 13 as x, the vertical position of the distal end of the bucket as y, and a target excavating grade as $\theta$.

In such a configuration, a grade command $\theta$a from a grade input means 17, a bucket inclination command $\phi$a from a distal end inclination input means 18, a detected value $\theta_1$a of the boom angle, a detected value $\theta_2$a of the arm angle, and a detection value $\theta_3$a of the bucket angle from working machine attitude detecting means 20*a*, 20*b*, and 20*c*, respectively, are supplied to an actuator operating amount computing means 19. This actuator operating amount computing means 19 calculates a target inclination of the bucket 13, a target path of the nose, and an actual inclination and an actual path of the bucket 13, then it calculates flow command values $V\theta_1$, $V\theta_2$, and $V\theta_3$ of a fluid to be supplied to the actuators for the boom 11, the arm 12, and the bucket 13 in order to move along the target path at the obtained bucket inclination. Based on the computed values, flow control valves 21*a*, 21*b*, and 21*c* are controlled to drive cylinders 14, 15, and 16.

Figure 14:
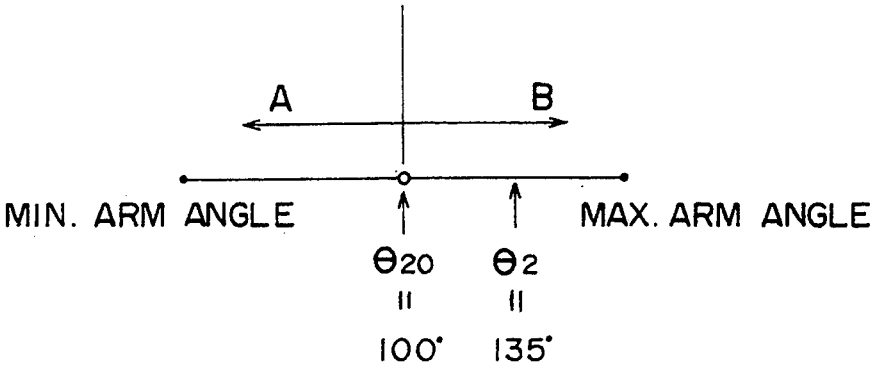
FIG. 14 is a diagram which shows a case wherein the working area of the arm is divided into two areas in accordance with the angle of the arm.

On the other hand, an excavating direction determining section 19*a* determines the excavating direction of the bucket 13 in accordance with the detected values $\theta_1$a, $\theta_2$a, and $\theta_3$a received from the working machine attitude detecting means 20*a*, 20*b*, and 20*c*, then outputs the result to the aforesaid computing means 19. The excavating direction determining section 19*a* determines the excavating direction by using an input value of an angle $\theta_2$ of the arm, the angle $\theta_2$ of the arm 12 and an angle $\theta_1$ of the boom 11, or an x-y coordinate system of the distal end of the arm 12. Specifically:

(a) When the arm angle $\theta_2$ is used for the determination:

As shown in FIG. 14, a working area of the arm 12 is divided into two areas based on a certain arm angle $\theta_{20}$. This reference angle $\theta_{20}$ is set in the excavating direction determining section 19*a* in advance, and this preset reference angle is compared with the detected value $\theta_2$ of the arm received from the working machine attitude detecting section 20*b* for the arm to determine the excavating direction.

$$\theta_{20}=\epsilon_0 \tag{6}$$

$\epsilon_0$: Set value

Figure 15:
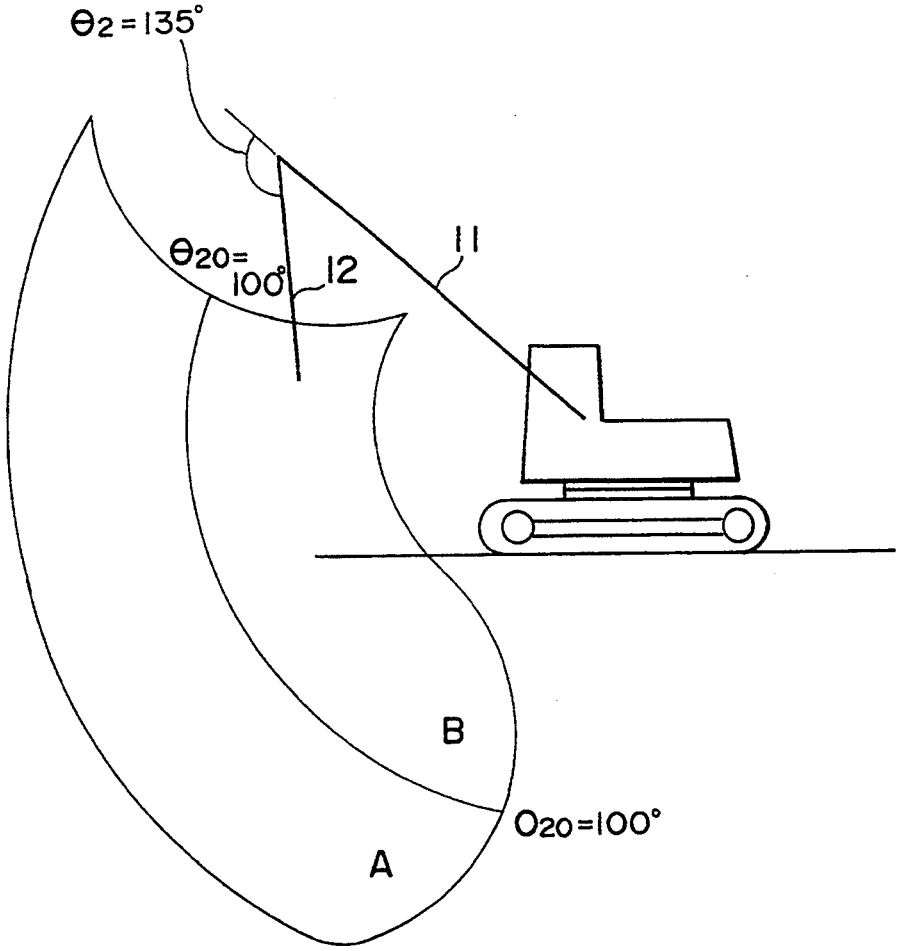
FIG. 15 is a two-dimensional view of a case wherein the working direction is determined in accordance with the angle of the arm.

If $\theta_2 \leqq \theta_{20}$, then the working area will be a farther area A and the excavation will be in the pulling direction. If $\theta_2 > \theta_{20}$, then the working area will be a closer area B and the excavation will be in the pushing direction. For example, if $\theta_{20}=100°$ and a control start point is $\theta_2=135°$ then $\theta_2>\theta_{20}$, which means the area B; therefore, the excavation will be in the pushing direction. This is shown two-dimensionally in FIG. 15.

Figure 16:
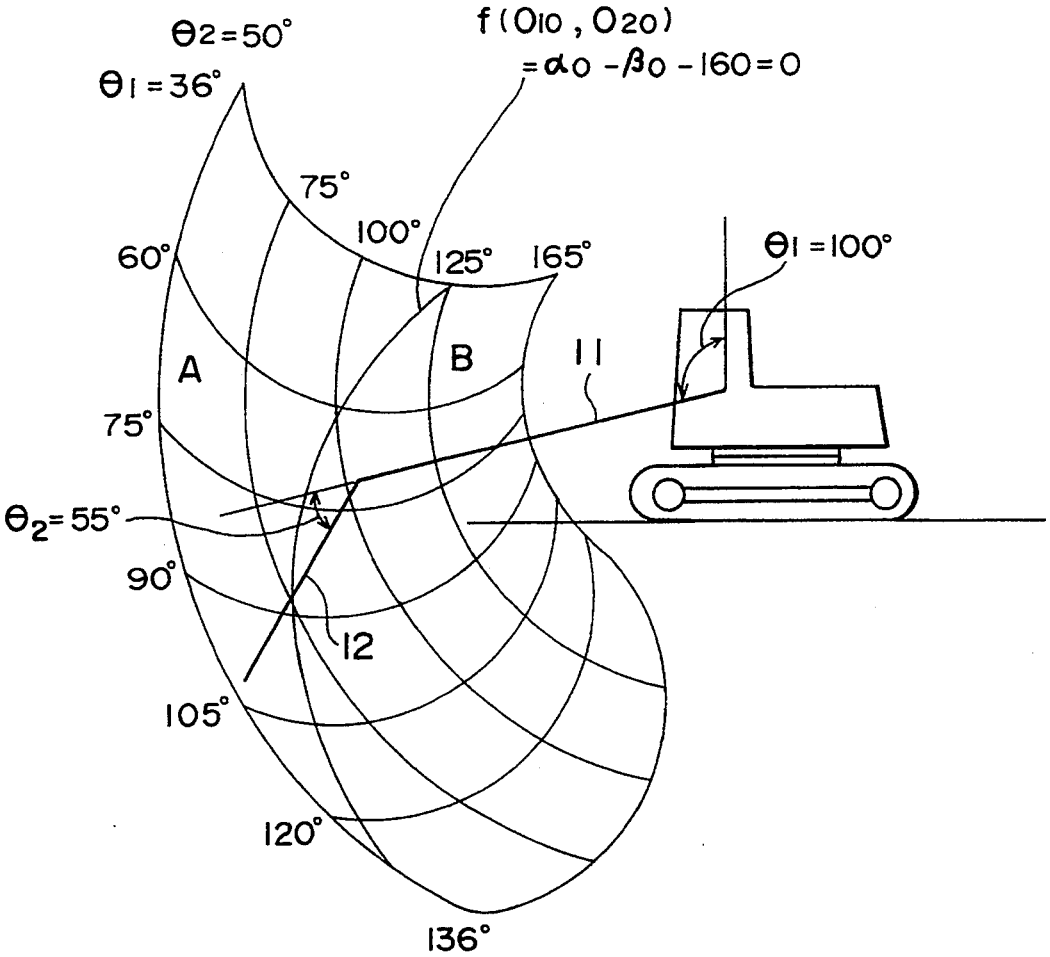
FIG. 16 is a two-dimensional view of a case wherein the working direction is determined in accordance with the angle of the arm and the angle of the boom.

(b) When the arm angle and the boom angle are used for the determination:

As shown in FIG. 16, the following boundary which divides the working area into two areas is A and B set in advance:

$$f(\theta_{10}, \theta_{20})=0 \tag{7}$$

The boom angle $\theta_1$ and the arm angle $\theta_2$ are substituted in the formula (7) and whether the working area belongs to the area A or to the area B depends on whether the left side member is positive or negative. The excavation will be in the pulling direction in the case of the area A, while the excavation will be in the pushing direction in the case of the area B.

For example, the boundary expressed by the following formula is set:

$$f(\theta_{10}, \theta_{20})=\theta_{10}+\theta_{20}-160=0 \tag{8}$$

And if the control start point is $(\theta_1, \theta_2)=(100, 55)$, then $$f(\theta_1, \theta_2)=100+55-160<0 \tag{9}$$

and the working area is determined as the farther area A, the excavation being in the pulling direction.

(c) When conversion into the x-y coordinate system is used for the determination (part 1):

From FIG. 13, the position (x, y) of the distal end of the arm is determined by $$x=L_1 \sin \theta_1+L_2 \sin (\theta_1+\theta_2),$$

$$y=L_1 \cos \theta_1+L_2 \cos (\theta_1+\theta_2) \tag{10}$$

Figure 17:
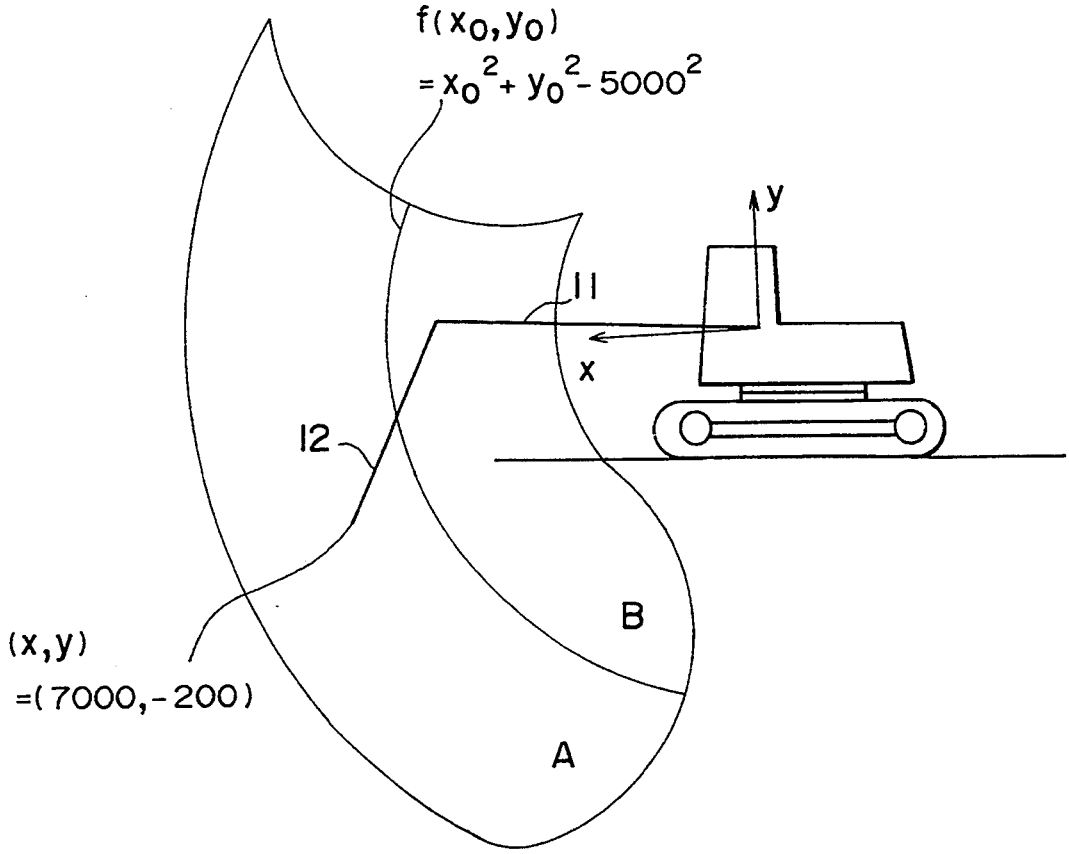
FIG. 17 is a two-dimensional view of a case wherein the working direction is determined by conversion to x-y coordinates.

And the boundary for dividing the working area into two areas as shown in FIG. 17, which is determined by the formula given below is set in advance:

$$f(X_0, Y_0)=0 \tag{11}$$

And x, y are substituted in the formula (11) and the area to which the working area belongs is determined by whether the left side member is positive or negative. The excavation will be in the pulling direction in the case of the area A, while the excavation will be in the pushing direction in the case of the area B.

For instance, $f(X_0, Y_0)=X_0^2+Y_0^2-5000^2=0$ is set and if the control start point (x, y) is (x, y)=(7000, 200) which is determined by the formula (10), then $f(x, y)=(7000^2+2002-5000^2)>0$, and the working area is determined as being the area A, the excavation being in the pulling direction.

Figure 18A:
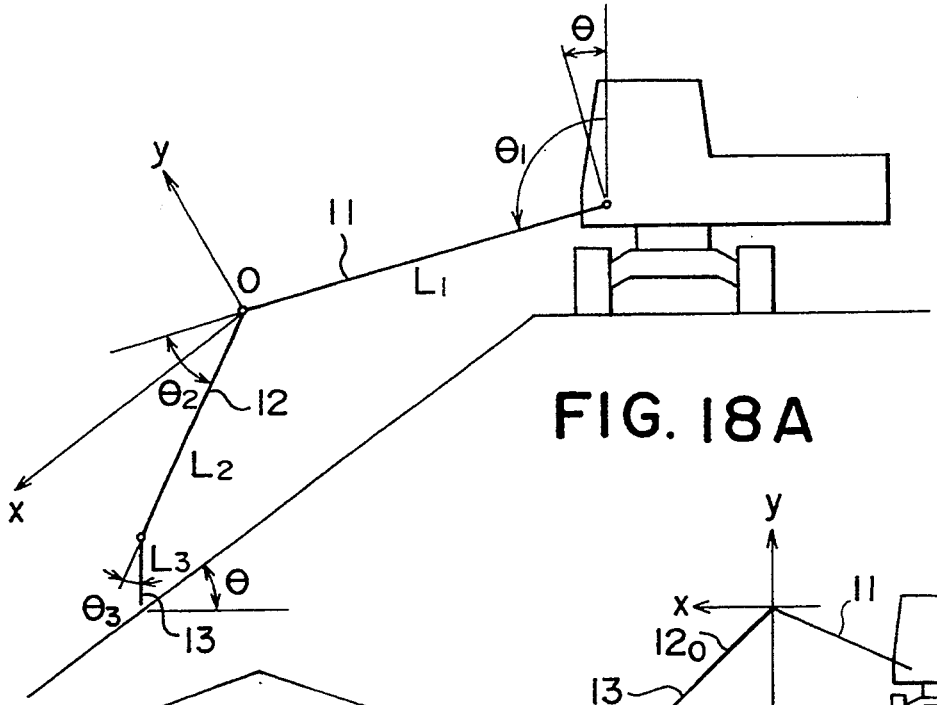
FIG. 18A and FIG. 18B are two-dimensional views of a case wherein the working direction is determined by conversion to x-y coordinates.

(d) When the conversion to the x-y coordinate system is used for the determination (part 2):

From FIG. 18A, with a point 0 of a boom top pin taken as the center of the coordinate, the position of the bucket nose is determined by $$x=L_2 \sin (\theta_1+\theta_2-\theta)+L_3 \sin (\theta_1+\theta_2+\theta_3-\theta) \tag{12}$$

Figure 18B:
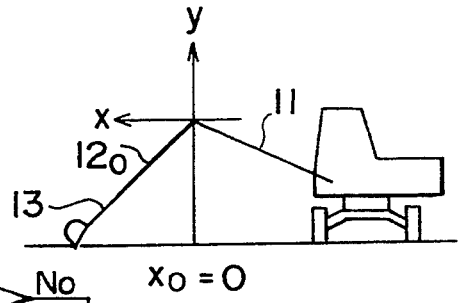

$X_0=0$ is defined in advance as shown in FIG. 18B, and this is compared with the x above: if $x>x_0$, then the excavation will be in the pulling direction; and if $x<x_0$, then it is in the pushing direction.

The boundary for dividing the working area into two areas, which is expressed by the formulas given above, can be fixed or it can vary according to the excavating grade or the angle of the working machine. For example, it can be preset as follows: if the excavating grade $\theta$ is $\leqq 30°$, then $\theta_{20}=100°$; and if the excavating grade $\theta$ is $>30°$, then $\theta_{20}=70°$.

Figure 19:
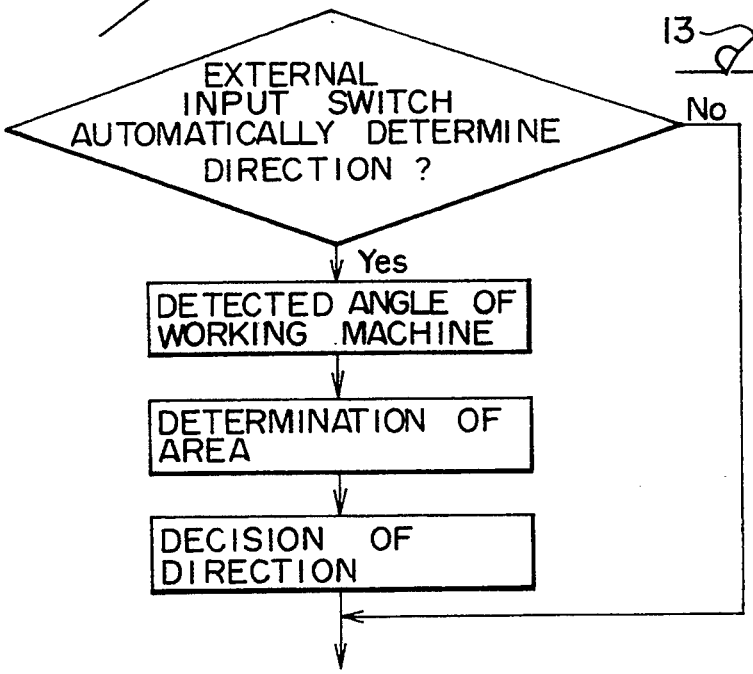
FIG. 19 is a flowchart for determining the working direction by means of the external input switch.

In addition, if the operator wishes to optionally decide the excavating direction, a changeover switch 22 is provided as shown in FIG. 12 and the operator sets for the pulling side or the pushing side by giving priority to the signal of the external input switch. In this case, the processing flow will be as shown in FIG. 19.

According to the fourth embodiment, the need of including the excavating direction among the input signals issued during excavating work is eliminated. This reduces operator fatigue from operation, preventing an operation error.

INDUSTRIAL APPLICABILITY

The present invention is useful as an automatic operation mode selecting method for a working machine, which method eliminates the need of correcting the angle of a bucket nose by a user even when the bucket provided on a construction machine, such as a hydraulic power shovel, is replaced by any optional special bucket, and enables path control as intended by an operator.

We claim:

1. Apparatus for selecting an automatic operation mode of a working machine in a construction equipment, wherein a distal end of a tip working machine is subjected to automatic linear path control and the tip working machine is associated with an arm, said apparatus comprising:

a tip working machine attitude detecting means, which detects a tip working machine attitude angle which is a relative attitude of the tip working machine with respect to the arm;

an allowable angle computing section for calculating an allowable angle held with respect to the ground, which indicates how long the tip working machine can hold a current angle to the ground in a turning direction of the tip working machine, the allowable angle being calculated from the tip working machine attitude angle and the turning direction of the tip working machine; and an operation mode determining section, which determines whether an operation mode is a nose-fixed mode, wherein the tip working machine holds the relative attitude with respect to the arm, or a fixed-angle to the ground mode, wherein the angle to the ground is held constant;

wherein said operation mode determining section makes the determination in accordance with the tip working machine attitude angle and the allowable angle held with respect to the ground when automatic linear path control is performed, with the determination being made by the operation mode determining section calculating, according to how far said tip working machine attitude angle deviates from a predetermined angle, a first possibility (U2) of the operation mode being the nose-fixed mode; by the operation mode determining section calculating, according to the magnitude of the calculated value of the allowable angle held with respect to the ground, a second possibility (U1) of the operation mode being the fixed-angle to the ground mode; and by the operation mode determining section automatically determining the operation mode during the automatic path control by comparing the thus calculated first and second possibilities (U2 and U1).

2. Apparatus in accordance with claim 1, further comprising a mode determining switch for manually selecting whether said operation mode is to be automatically determined, or the nose-fixed mode or the fixed-angle to the ground mode is to be forcibly set.

3. Apparatus in accordance with claim 1, further comprising indicator lamps and means for applying an output from the operation mode determining section to the indicator lamps to show whether an automatic determination value of said operation mode indicates the nose-fixed mode or the fixed-angle to the ground mode.

4. Apparatus in accordance with claim 1, further comprising an operating lever of said working machine, a knob switch provided on said operating lever, and means for inverting a determination value of the operation mode determining section and outputting the thus inverted determination value when the knob switch is actuated.

5. Apparatus for selecting automatic operation mode of a tip working machine in construction equipment, wherein a distal end of the tip working machine is subjected to automatic linear path control and the tip working machine is associated with an arm, said apparatus comprising:

a tip working machine attitude detecting means, which detects the tip working machine attitude angle, which is a relative attitude of the tip working machine with respect to the arm;

an allowable angle computing section for calculating an allowable angle held with respect to the ground, which indicates how long the tip working machine can hold a current angle to the ground in a turning direction of the tip working machine, the allowable angle being calculated in accordance with the tip working machine attitude angle and the turning direction of the tip working machine; and an operation mode determining section, which determines whether the operation mode is a nose-fixed mode, wherein the tip working machine holds the relative attitude with respect to the arm, or a fixed-angle to the ground mode, wherein the angle to the ground is held constant;

wherein said operation mode determining section makes the determination in accordance with said allowable angle held with respect to the ground when the automatic linear path control is performed, with the determination being made by the operation mode determining section calculating, according to the magnitude of the calculated value of the allowable angle held with respect to the ground, a possibility (U1) of the operation mode being the fixed-angle to the ground mode, and by the operation mode determining section automatically determining the operation mode during the automatic linear path control in accordance with the magnitude of the thus calculated possibility (U1).

6. Apparatus in accordance with claim 5, further comprising a mode determining switch for manually selecting whether said operation mode is to be automatically determined, or the nose-fixed mode or the fixed-angle to the ground mode is to be forcibly set.

7. Apparatus in accordance with claim 5, further comprising indicator lamps and means for applying an output from the operation mode determining section to the indicator lamps to show whether an automatic determination value of said operation mode indicates the nose-fixed mode or the fixed-angle to the ground mode.

8. Apparatus in accordance with claim 5, further comprising an operating lever of said working machine, a knob switch provided on said operating lever, and means for inverting a determination value of the operation mode determining section and outputting the thus inverted determination value when the knob switch is actuated.

9. Apparatus for selecting an automatic operation mode of a working machine in a construction equipment, wherein a distal end of a tip working machine is subjected to automatic linear path control and the tip working machine is associated with an arm, said apparatus comprising:

a tip working machine attitude detecting means, which detects a tip working machine attitude angle which is a relative attitude of the tip working machine with respect to the arm; and an operation mode determining section, which determines whether an operation mode is a nose-fixed mode, wherein the tip working machine holds the relative attitude with respect to the arm, or a fixed-angle to the ground mode, wherein the angle to the ground is held constant;

wherein said operation mode determining section makes the determination in accordance with the tip working machine attitude angle when automatic linear path control is performed, with the determination being made by the operation mode determining section calculating, according to how far said tip working machine attitude angle deviates from a predetermined angle, a possibility (U2) of the operation mode being the nose-fixed mode; and by the operation mode determining section automatically determining the operation mode during the automatic linear path control in accordance with the magnitude of the thus calculated possibility (U2).

10. Apparatus in accordance with claim 9, further comprising a mode determining switch for manually selecting whether said operation mode is to be automatically determined, or the nose-fixed mode or the fixed-angle to the ground mode is to be forcibly set.

11. Apparatus in accordance with claim 9, further comprising indicator lamps and means for applying an output from the operation mode determining section to the indicator lamps to show whether an automatic determination value of said operation mode indicates the nose-fixed mode or the fixed-angle to the ground mode.

12. Apparatus in accordance with claim 9, further comprising an operating lever of said working machine, a knob switch provided on said operating lever, and means for inverting a determination value of the operation mode determining section and outputting the thus inverted determination value when the knob switch is actuated.

13. Apparatus for selecting automatic operation mode of a tip working machine of an excavating construction equipment having an arm associated with said tip working machine, a boom associated with the arm, a tip working machine actuator associated with the tip working machine, an arm actuator associated with the arm, and a boom actuator associated with the boom, said apparatus comprising:

a detector for providing an attitude angle signal representative of a turning angle of the tip working machine with respect to the arm, a detector for providing an arm angle signal representative of a turning angle of the arm with respect to the boom, a detector for providing a boom angle signal representative of a turning angle of the boom, an excavating direction determining unit for providing a direction signal representative of an excavating direction of the tip working machine, a grade input device for providing a grade signal representative of the grade of a surface to be excavated;

an inclination input devices for providing a inclination signal representative of a target inclination of the tip working machine with respect to a reference plane, and an actuator operating amount computer for receiving the attitude angle signal, the arm angle signal, the boom angle signal, the direction signal, the grade signal, and the inclination signal, and providing responsive thereto actuator control signals for controlling the tip working machine actuator, the arm actuator, and the boom actuator so that a distal end of the tip working machine follows a target path.

14. Apparatus in accordance with claim 13, wherein said excavating direction determining unit receives the attitude angle signal, the arm angle signal, and the boom angle signal, and provides responsive thereto the direction signal representative of an excavating direction of the tip working machine.

15. Apparatus in accordance with claim 13, wherein said excavating direction determining unit is provided with a preset reference signal representing a certain arm angle, and wherein said excavating direction determining unit receives the arm angle signal and compares the arm angle signal with the preset reference signal, and provides the direction signal in response to the comparison.

16. Apparatus in accordance with claim 15, wherein the tip working machine is excavating in a pushing direction when the arm angle signal is greater than the preset reference signal, and the tip working machine is excavating in a pulling direction when the arm angle signal is smaller than the preset reference signal.

17. Apparatus in accordance with claim 13, wherein said excavating direction determining unit receives the arm angle signal and the boom angle signal, and provides responsive thereto the direction signal representative of an excavating direction of the tip working machine.

18. Apparatus in accordance with claim 13, wherein said excavating direction determining unit provides the direction signal in response to x-y coordinate system position of a distal end of the arm.

19. Apparatus in accordance with claim 13, wherein said excavating direction determining unit provides the direction signal in response to x-y coordinate system position of a distal end of the tip working machine.

20. Apparatus in accordance with claim 13, further comprising an external input switch, wherein said excavating direction determining unit gives priority to the external input switch during the automatic determination of the excavating direction of the tip working machine.

* * * * *